US007343830B2

(12) United States Patent
Rinero et al.

(10) Patent No.: US 7,343,830 B2
(45) Date of Patent: Mar. 18, 2008

(54) ADJUSTABLE PEDAL UNIT FOR A MOTOR-VEHICLE

(75) Inventors: Enrico Rinero, Orbassano (IT); Roberto Pizzoni, Orbassano (IT)

(73) Assignee: CRF Societa Consortile per Azioni, Orbassano (Torino) (IT)

( * ) Notice: Subject to any disclaimer, the term of this patent is extended or adjusted under 35 U.S.C. 154(b) by 624 days.

(21) Appl. No.: 10/500,490

(22) PCT Filed: Sep. 30, 2003

(86) PCT No.: PCT/IB03/04316

§ 371 (c)(1),
(2), (4) Date: Jun. 30, 2004

(87) PCT Pub. No.: WO2004/034170

PCT Pub. Date: Apr. 22, 2004

(65) Prior Publication Data

US 2005/0115354 A1 Jun. 2, 2005

(30) Foreign Application Priority Data

Oct. 8, 2002 (IT) ..... TO2002A0866

(51) Int. Cl.
*G05G 1/14* (2006.01)

(52) U.S. Cl. ..... 74/512

(58) Field of Classification Search ..... 74/512, 74/513, 560

See application file for complete search history.

(56) References Cited

U.S. PATENT DOCUMENTS

| | | | | |
|---|---|---|---|---|
| 956,681 | A * | 5/1910 | Clarke | 108/4 |
| 6,364,047 | B1 | 4/2002 | Bortolon | |
| 6,527,327 | B2 * | 3/2003 | Gaus et al. | 296/75 |
| 6,834,904 | B2 * | 12/2004 | Sauvonnet et al. | 296/75 |
| 6,862,950 | B2 * | 3/2005 | O'Neill | 74/512 |
| 6,962,094 | B2 * | 11/2005 | Porter et al. | 74/512 |

FOREIGN PATENT DOCUMENTS

| | | |
|---|---|---|
| DE | 197 27 308 A | 1/1999 |
| GB | 1 278 919 A | 6/1972 |
| IT | 1 245 293 B | 9/1994 |

* cited by examiner

*Primary Examiner*—Vicky A. Johnson
(74) *Attorney, Agent, or Firm*—Sughrue Mion, PLLC

(57) ABSTRACT

An adjustable pedal unit for a motor vehicle includes a first plate onto which are mounted at least the accelerator pedal (2) and the footbrake pedal (3). The plate is mounted slidingly onto longitudinal guides inclined upwardly and forwardly, so that in the most withdrawn position (referring to motor vehicle driving direction) of the pedal unit, the pedals are placed in a lower position. Conversely, in the most forward position of the pedal unit, the pedals are paced in a higher position. The driver's heels rest on a second plate (2) moving longitudinally together with the first plate (1) when the latter is adjusted in position, however always on a basically horizontal plane. An auxiliary footboard may be provided for resting the foot that does not actuate the accelerator and footbrake pedal (2, 3).

6 Claims, 3 Drawing Sheets

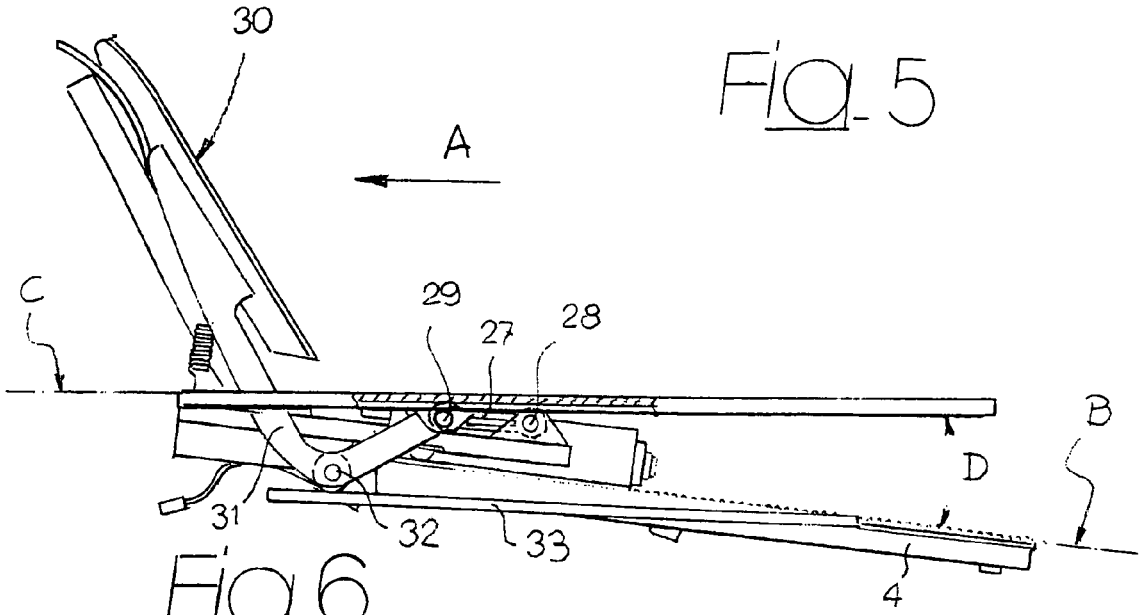
Fig. 5
Fig. 6
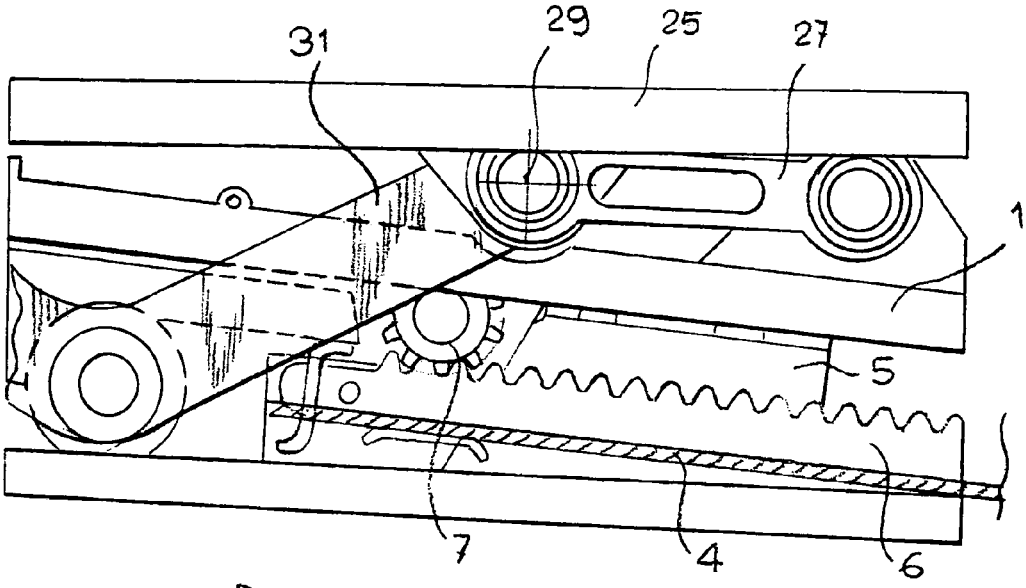
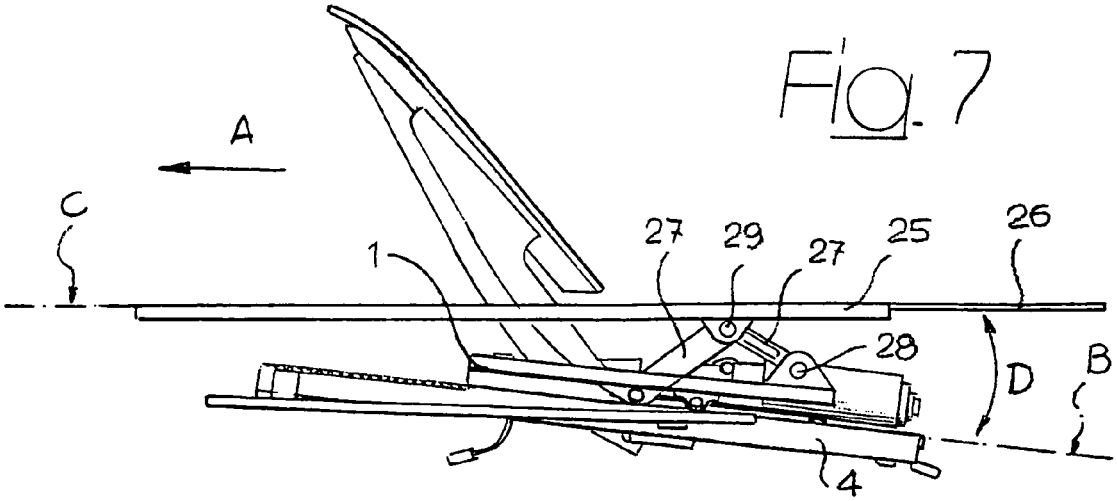
Fig. 7

ADJUSTABLE PEDAL UNIT FOR A MOTOR-VEHICLE

BACKGROUND OF THE INVENTION

This is a National Stage of Application No. PCT/IB03/04316 filed Sep. 29, 2003; the disclosure of which is incorporated herein by reference.

The present invention relates to adjustable pedal units for motor vehicles.

It has already been proposed to carry out pedal units for the driver's seat enabling to adjust pedal position in motor vehicle longitudinal direction, in order to allow people having different builds and heights to sit comfortably while driving. By way of example, one of said solutions is disclosed in Italian Patent IT-A-1,245,293.

Studies and essays carried out by the Applicant have led to show that all previous solutions are not ideal as far as comfortableness of driver's position and in particular easy actuation of pedals are concerned.

Among other things it appears that many prior art solutions, such as the one being the object of the document referred to above, share the same technical prejudice, according to which it was believed that shorter people needed not only pedals placed in withdrawn position (referring to motor vehicle driving direction), but also placed in a higher position. Conversely, studies made by the Applicant have led to find that first of all, if people with different heights need pedals placed in different positions in motor vehicle longitudinal direction, the surface which the driver's heels rest on should however be basically the same; and that secondly, when pedals are placed in a withdrawn position so as to enable a shorter person to sit comfortably while driving, it is however desirable—since the surface which heels rest on is always the same—that said pedals are in a lower position, so as to prevent the driver's foot from taking an uncomfortable position for their actuation.

SUMMARY OF THE INVENTION

Starting from the basic ideas referred to above, which are the result of studies carried out by the Applicant, the invention aims at proposing a new adjustable pedal unit for motor vehicles, which is basically better than those previously suggested from the point of view of manufacturing simplicity and low costs, of application simplicity, possibly also for a motor vehicle initially without adjustable pedal unit, and especially from the point of view of ergonomics of driver's seat and convenience of use, for an ample range of variability of driver's features, and in particular of his/her height.

In the light of achieving said aim, the object of the present invention is an adjustable pedal unit for motor vehicle comprising:

a first plate, to which at least an accelerator pedal and a footbrake pedal are articulated, said plate being mounted slidingly onto longitudinal guides inclined forwards upwards, said longitudinal guides being stiffly connected to motor vehicle floor, means for controlling the sliding and blocking in position of the first plate onto the aforesaid guides, a second plate for resting the driver's heels, mounted slidingly on a basically horizontal plane above the aforesaid first plate onto corresponding longitudinal guides, which are also stiffly connected to motor vehicle floor, connecting means with articulated levers between the first plate and the second plate, which put the second plate into motion thanks to the first plate pulling it, when the latter is adjusted in position, said connecting means enabling at the same time the first plate and the second plate to slide on their respective sliding planes.

In the adjustable pedal unit according to the invention, the surface which the driver's heels rest on comprises the aforesaid second plate, which moves longitudinally together with the pedal unit when the latter is adjusted in position, though it is always on the same horizontal plane. In other words, the surface which heels rest on is always at a constant level even during pedal unit adjustment. At the same time, when the pedal unit is withdrawn (referring to motor vehicle driving direction) to be adjusted to a shorter driver, the pedal themselves move in the direction of their corresponding longitudinal guides inclined upwards forwards (and as a consequence, obviously, downwards backwards). Therefore, in their most withdrawn position the pedals are lower, thus enabling the driver's foot to be comfortably placed during actuation, though heels can be kept in contact with the second plate.

In a preferred embodiment, the pedal unit according to the invention further comprises an auxiliary footboard only for resting the foot that is not used to actuate accelerator and brake, which auxiliary footboard is supported by an arm articulated to the aforesaid second plate and which further supports a guide roll engaged onto a stationary longitudinal track, so that said auxiliary footboard moves together with the second plate when the latter moves longitudinally after an adjustment of pedal unit position and takes an inclination in every position due to the contact of the aforesaid guide roll with the aforesaid stationary track.

BRIEF DESCRIPTION OF THE DRAWINGS

Further characteristics and advantages of the invention shall be evident from the following description referring to the accompanying drawings, provided as a mere non-limiting example, in which:

FIGS. 5 and 7 are lateral views of the pedal unit, showing the latter in two different longitudinal positions, and FIG. 6 is a magnified scale view of a detail of FIG. 5.

DETAILED DESCRIPTION OF THE DRAWINGS

Figure 1:
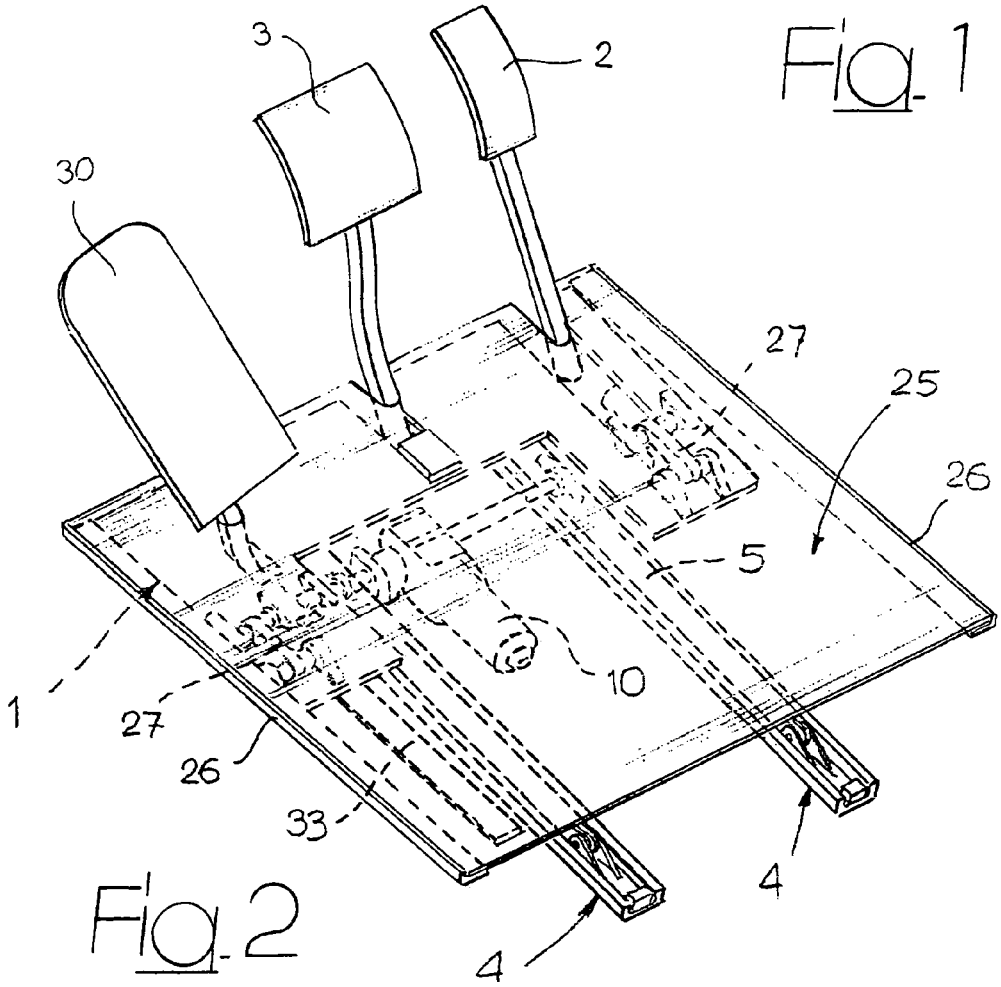
FIG. 1 is a schematic perspective view of a pedal unit according to the invention.

In the preferred embodiment shown in the drawings, it is provided for a first plate 1 (shown with a hatched line in FIG. 1) onto which an accelerator pedal 2 and a footbrake pedal 3 are mounted, as shall be described in the following. The plate 1 is mounted slidingly onto longitudinal guides 4 stiffly connected to motor vehicle floor and having an orientation inclined upwards forwards, i.e. in motor vehicle driving direction, as can be clearly seen for instance in FIG. 5 or in FIG. 7, where said driving direction is indicated by arrow A.

Figure 2:
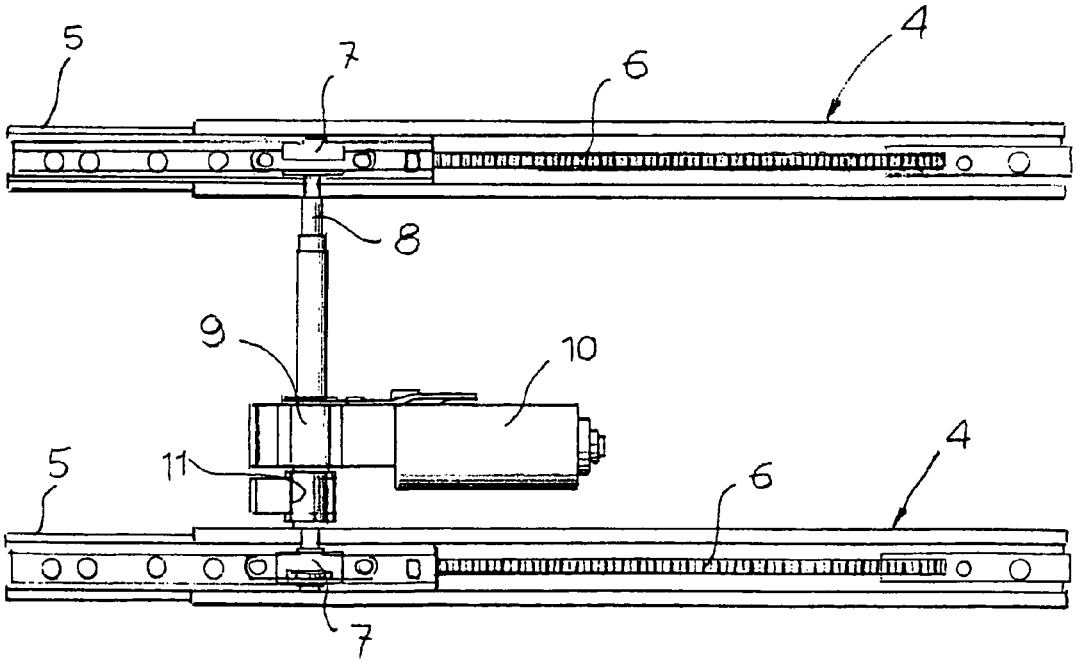
FIG. 2 is a plan view of a detail of the pedal unit of FIG. 1.

FIG. 2 shows a plan view of the guides 4 consisting of two metal section bars stiffly fastened to motor vehicle floor. Two mobile guides 5 onto which the plate is stiffly connected are mounted slidingly within said section bars (see also FIG. 6) according to a technique resembling the one used for the longitudinal adjustment of motor vehicle seats. Also the mobile guides 5 consist of metal section bars having a suitable section so as to be slidingly mounted into the section bars which the stationary guides 4 consist of. Said stationary guides 4 further have on their bottom corresponding racks 6 (FIG. 2) engaged by sprocket wheels 7 mounted onto the end of a cross shaft 8 mounted turnably onto the assembly comprising the two mobile guides 5. The rotation of said shaft 8 can be controlled by means of a reduction gear 9 and an electric motor 10 whose frame is also associated to the assembly including the mobile guides 5. When the electric motor 10 is actuated, therefore, it causes a rotation of the sprocket wheels 7, which thus roll on the rack 6 and cause the movement of the mobile guides 5 with respect to the stationary guides 4. The assembly comprising the sprocket wheels 7, the shaft 8 and the speed reducer 9, 10 follows the mobile guides 5 in their movement. The speed reducer is also associated to a position sensor 11, for instance an encoder, which enables an electronic control of the position of the mobile guides. Obviously, when the electric motor 10 is not working, the mobile guides will automatically be blocked in their current position. As was already said, the pedals 2, 3 are supported by the aforesaid plate 1 mounted onto the mobile guides 5.

Figure 3:
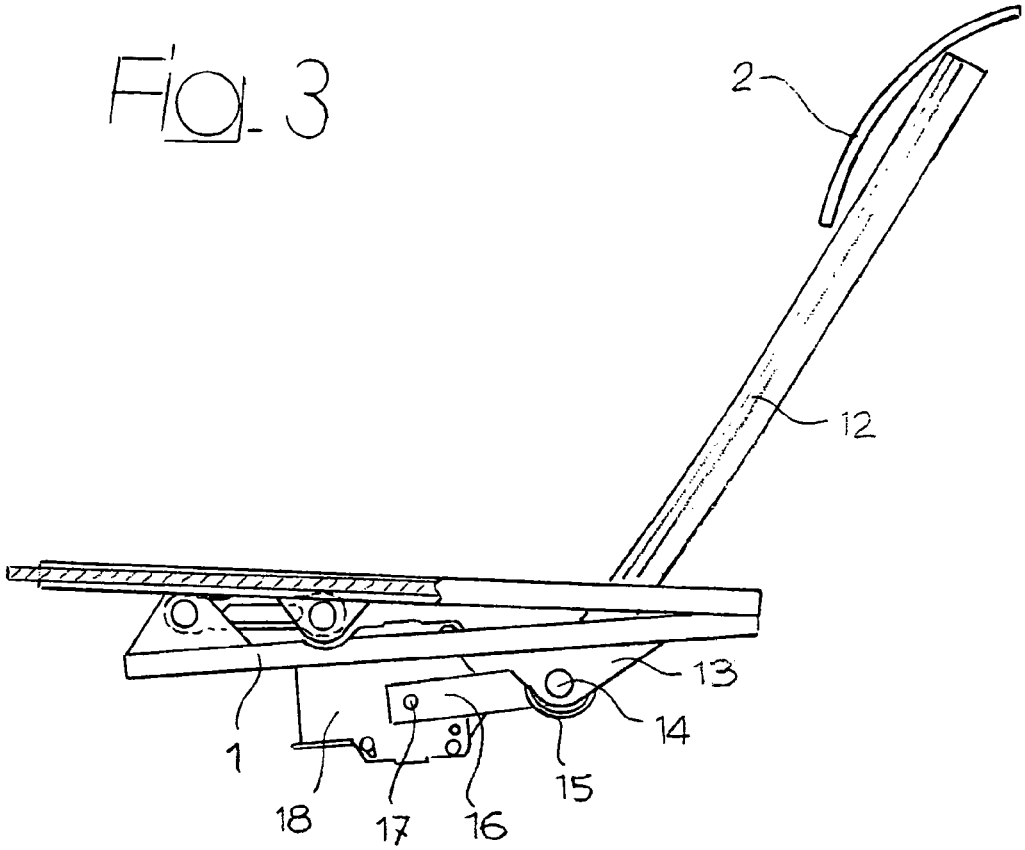
FIG. 3 is a schematic lateral view of the accelerator pedal belonging to the pedal unit according to the invention.

FIG. 3 shows how the accelerator pedal 2 is supported by an arm 12 articulated onto a bracket 13 stiffly connected to the first plate 1 by means of an articulation pin 14. On the articulated joint 14 it is also provided for a spring 15 tending to keep the accelerator pedal 2 in an uplifted rest position. The arm 12 is also associated to an auxiliary element 16 with a pin 17 cooperating with a potentiometer 18 in order to enable to detect the position of the pedal 2 and subsequently to control the motor vehicle engine.

Figure 4:
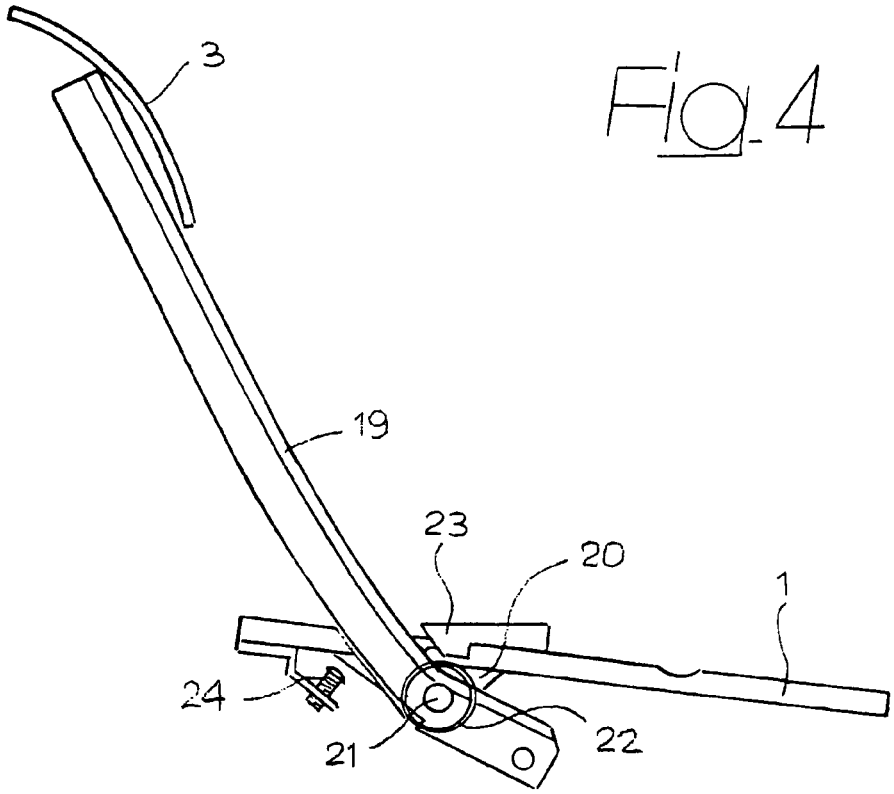
FIG. 4 is a schematic lateral view of the footbrake pedal.

FIG. 4 shows the footbrake pedal 3 supported by an arm 19 articulated to a bracket 20 stiffly connected to the first plate 1 by means of an articulation pin 21 on which it is also provided for a spring 22 tending to pull the pedal back towards an uplifted rest position. The arm 19 is also associated to stroke-end elements 23, 24 to limit rotation upwards and downwards, respectively. The end of the arm 19 opposite the pedal 3 is obviously designed to be connected to the braking system in any known way.

Above the first plate 1, which is mounted slidingly in longitudinal direction, as was already mentioned, along the inclined plane B (see FIGS. 5, 7) a second plate 25 is mounted slidingly, which acts as support for the driver's heels. The plate 25 is mounted slidingly into two lateral longitudinal guides 26 (FIG. 1) on a basically horizontal plane (referred to with C in FIGS. 5 and 7).

When the position of the pedal unit is adjusted by checking through the motor 10 the position of the plate 1 onto which the pedals 2, 3 are mounted, also the second plate 25 moves longitudinally, pulled by the first plate 1, since both plates are connected one to the other on their two sides by means of connecting rods 27, each of them being articulated in 28 to the frame of plate 1 and in 29 to the frame of plate 25. The connecting rods 27 allow on one side the plate 25 to be pulled by the plate 1 when the latter is shifted longitudinally so as to adjust pedal position, and on the other enable both plates 1 and 2 to move on their respective planes B and C, although said planes form together an angle D (see FIGS. 5, 7). Obviously, in the most forward position of the pedal unit (FIG. 5) the plates 1 and 25 will be relatively closer one to the other, so that the connecting rods 27 will take the basically horizontal position as shown in FIG. 5, whereas in the most withdrawn position of the pedal unit (FIG. 7) the plates 1 and 25 will be at a greater vertical distance one from the other, so that the connecting rods 27 will take the rotated position as shown in FIG. 7.

It should still be pointed out that the pedal unit according to the invention comprises an auxiliary footboard 30 for resting the foot that does not actuate accelerator and footbrake pedals 2, 3 (i.e. for resting the left foot in case of a left-hand drive motor vehicle).

The auxiliary footboard 30 is supported by an elbow arm 31 whose end opposite the footboard is articulated to the plate 25 on the pin 29. Therefore, the footboard 30 follows the plate 25 when the latter moves due to the adjustment of the pedal unit. Moreover, on its elbow the arm 31 supports a guide roll 32, turning freely, which is engaged onto a stationary guide track 33. A spring 34 connecting the footboard 30 to the frame of the plate 25 keeps the guide roll 32 constantly in contact with the stationary track 33. Said contact results in the angle taken by the footboard 30 for each of the longitudinal adjustment positions of the footboard.

As can be inferred form the preceding description, the footboard according to the invention has a relatively simple and cheap structure. It enables on one side to adjust the longitudinal position of the pedals to the driver's height, however keeping unchanged the plane C which the driver's heels rest on. Furthermore, the more the pedal unit is withdrawn, the lower is the position of the pedals, and conversely, the more the pedal unit gets forward, the higher is the position of the pedals. As was already said, said result enables an optimal adjustment of the position of the pedals to the driver's features, ensuring under every condition a comfortable driving position and in particular a correct foot position during pedal actuation.

For instance, although the accompanying drawings refer to an embodiment in which the movement for adjusting the pedal unit is provided by a motor, it could also be theoretically possible to envisage a manual control of the movement of the plate 1 with respect to the stationary guides 4. In such a case, it would obviously be necessary to arrange also means for blocking the plate in the selected position (which in the motorized solution comprise said motor, which in un-actuated state prevents the sprocket wheels 7 from rotating), being it possible to carry out said means for instance wholly similarly to the analogous means envisaged in the devices for the longitudinal adjustment of motor vehicle seats.

Obviously, though the basic idea of the invention remains the same, construction details and embodiments can widely vary with respect to what has been described and shown by mere way of example, however without leaving the framework of the present invention.

The invention claimed is:

1. An adjustable pedal unit for motor vehicle, comprising:

a first plate (1), to which at least an accelerator pedal (2) and a footbrake pedal (3) are articulated, said first plate being mounted slidingly onto first longitudinal guides (4) inclined forwardly and upwardly and being connected to a motor vehicle floor, means (6-10) for controlling the sliding and locking of the first plate (1) on the first longitudinal guides (4), a second plate (25) for supporting the driver's heels, mounted slidingly on second longitudinal guides (26) in a substantially horizontal plane (C) above the first plate (1), connecting means (27) with articulated levers between the first plate (1) and the second plate (25), said connecting means being configured to move the second plate (25) upon adjustment of the first plate (1) said connecting means (27) enabling at the same time the first plate (1) and the second plate (25) to slide in their respective sliding planes (B, C).

2. Adjustable pedal unit according to claim 1, further comprising an auxiliary footboard for resting the foot that does not actuate the footbrake and accelerator pedals (2, 3), said auxiliary footboard (30) being supported by an arm (31) articulated to the second plate (25) and further supporting a guide roll (32) engaged onto a stationary longitudinal track (33).

3. Adjustable pedal unit according to claim 2, wherein the connecting means with articulated levers comprise two connecting rods (27) having each end articulated to the first plate (1) at a first articulated joint and the opposite end articulated to the second plate (25) at a second articulated joint, the axes of said first and second articulated joints being oriented transversally with respect to motor vehicle longitudinal direction.

4. Adjustable pedal unit according to claim 3, wherein the arm (31) supporting the auxiliary footboard (30) is articulated to the second plate (25) around an articulation axis (29) corresponding to the articulation axis (29) of the second plate (25) to the connecting rods (27).

5. Adjustable pedal unit according to claim 1, wherein the first plate (1) is mounted slidingly onto two of the first longitudinal guides (4), including metal section bars into which are mounted slidingly two corresponding metal section bars forming mobile guides (5) to which said first plate (1) is fastened.

6. Adjustable pedal unit according to claim 5, wherein the controlling means includes a motor reducer assembly (9, 10); a cross shaft (8) actuated by the motor reducing assembly; two sprocket wheels (7) mounted on the cross shaft; and longitudinal racks (6) fastened to the first longitudinal guides (4) and engaged by the sprocket wheels.

* * * * *